United States Patent [19]

McKibben et al.

[11] Patent Number: 5,054,155

[45] Date of Patent: Oct. 8, 1991

[54] APPARATUS FOR CLEANING PASSAGEWAYS IN METAL CASTINGS

[75] Inventors: Kenneth D. McKibben, Defiance, Ohio; Thomas E. Wuepper, Alger, Mich.

[73] Assignee: CMI International, Inc., Southfield, Mich.

[21] Appl. No.: 633,296

[22] Filed: Dec. 24, 1990

Related U.S. Application Data

[62] Division of Ser. No. 481,629, Feb. 16, 1990.

[51] Int. Cl.[5] ..... B08B 9/02

[52] U.S. Cl. ..... 15/304; 15/94; 15/309.2; 15/316.1; 15/406

[58] Field of Search ..... 15/304, 316.1, 406, 15/303, 309.2, 94

[56] References Cited

U.S. PATENT DOCUMENTS

| | | | |
|---|---|---|---|
| 2,830,005 | 4/1958 | Kleeman et al. | 15/94 X |
| 3,117,726 | 1/1964 | Schoberg | 239/291 |
| 3,159,164 | 12/1964 | McBrady | 134/67 |
| 3,419,429 | 12/1968 | Zadron | 134/33 |
| 3,638,269 | 2/1972 | Campbell | 15/94 |
| 3,989,537 | 11/1976 | Sickmeier | 134/1 |
| 4,325,161 | 4/1982 | Wood et al. | 15/304 |
| 4,365,383 | 12/1982 | Bartlett | 15/309.2 X |
| 4,381,577 | 5/1983 | Boye et al. | 15/94 X |
| 4,639,968 | 2/1987 | McKibben et al. | 15/304 |
| 4,777,689 | 10/1988 | Brenner et al. | 15/94 |

*Primary Examiner*—Chris K. Moore

*Attorney, Agent, or Firm*—Harness, Dickey & Pierce

[57] ABSTRACT

Metal castings, having a number of internal passageways which open at different surface portions of the castings, are mounted upon a horizontal axis wheel-like frame. The frame is intermittently rotated and momentarily stopped so that castings are rotated at times and stationary at times. During the times that the castings are stationary, they are simultaneously subjected to either an externally applied vibration or to a momentary, several millisecond long, high pressure burst of air through their respective passageways. The alternating vibrations and momentary bursts of air loosen and remove the sand and other casting debris contained within the passageways. Additionally, the changing angularity of the castings, due to the rotation, coupled with the vibrations and bursts of air, dislodge such sand and debris from the walls and, also, downwardly out of the passageways.

5 Claims, 1 Drawing Sheet

APPARATUS FOR CLEANING PASSAGEWAYS IN METAL CASTINGS

This is a divisional of co-pending patent application Ser. No. 07/481,629, filed Feb. 16, 1990.

BACKGROUND OF INVENTION

This invention relates to cleaning sand and other casting debris from the interior passageways formed in a sand cast, metal casting. Cast metal parts are commonly made by pouring molten metal into cavities formed in sand molds. Upon solidification of the metal, the sand mold is broken and the sand is separated from the metal part. Frequently, sand particles and other casting debris are lodged upon or adhered to the surfaces of the metal part. This material is removed through various cleaning techniques.

In casting a part which has interior passageways or hollow portions, it is common to use a core which may be made of sand and a suitable adhesive or resin, baked or otherwise solidified to form an obstacle around which the molten metal is cast within the sand mold cavity. After the metal is solidified, the interior core is broken out or otherwise removed, leaving the passageways or hollow portions within the casting. The removal of sand particles or other casting debris from the interior of the cast part, that is, from within the interior cavities or passageways is somewhat difficult and takes considerable time, depending upon the nature and shape of the part.

By way of example, cast internal combustion engine parts, such as the engine head or the engine block, are formed with numerous internal passageways which are difficult to clean following the casting of the metal. In high production foundries, the amount of time and material required for cleaning a casting, particularly the interior passageways and cavities within the casting, is important and, therefore, efforts have been made to clean such parts rapidly and effectively in order to reduce the expense of manufacturing the part.

An example of equipment developed for cleaning castings is disclosed in my prior U.S. Pat. No. 4,639,968, issued Feb. 3, 1987 to McKibben, Gould, Groh and Wuepper, for a Machine for Cleaning Castings. This patent illustrates a wheel, which rotates about a horizontal axis, upon which castings are mounted for movement through a number of cleaning stations. Alternating high pressure and low pressure blasts of air are applied to openings in the castings in opposite directions so as to loosen and blow out adhered sand or other debris. But, that equipment, and other available cleaning equipment are not always able to remove adhered sand and other debris from some relative long or curved interior spaces or of passageways formed within some cast metal parts. In the case of some cast engine parts, particularly engine heads and manifold parts having long and multiply curved internal passageways, there has been a need for a faster acting mechanism and method for better cleaning such castings in high production facilities.

Consequently, the invention herein concerns an improved method and apparatus cleaning the interior passageways of a castpart involving repetitive, alternating cycles of first, vibrating the entire casting and, second, applying an extremely short duration, high pressure air blast into the passageways.

SUMMARY OF INVENTION

This invention is concerned with rapidly cleaning interior passageways and cavities formed during the casting of metal parts in sand casting operations, by alternatingly applying vibrations to the casting and high powered, short duration bursts of highly compressed air blasts through the passageways, while rotating the castings between the periodic vibration and air blast applications. Cast metal parts are attached to a rotating, horizontally axised, ferris wheel-like frame and are rotated by the frame through a number of stations which alternatively apply vibration and the bursts of air until a 360 degree rotation of the part is achieved. Then, the casting is removed from the frame. The frame simultaneously supports a number of castings for mass production cleaning.

An object of this invention is to provide an inexpensive, very rapid and effective means for cleaning internal passageways in cast parts, utilizing little, if any, manual labor so as to reduce the manufacturing costs of the part.

A further object of this invention is to provide a mass production system for cleaning metal parts that are cast in sand molds which utilize cores for forming internal passageways within the cast parts.

Another object of this invention is to provide a means for cleaning the internal passageways of a cast metal part by utilizing a high pressure burst of air applied through the passageways for a very short time period, such as a few milliseconds, to produce an explosion-like effect within the passageways. The short burst of air is alternatingly applied between applications of vibrations to the cast metal part and the part is turned relative to the horizontal, so that the interior cavities and passageways of the casting are cleaned automatically without hand labor.

These and other objects and advantages of this invention will become apparent upon reading the following description, of which the attached drawings form a part.

DETAILED DESCRIPTION

Figure 1:
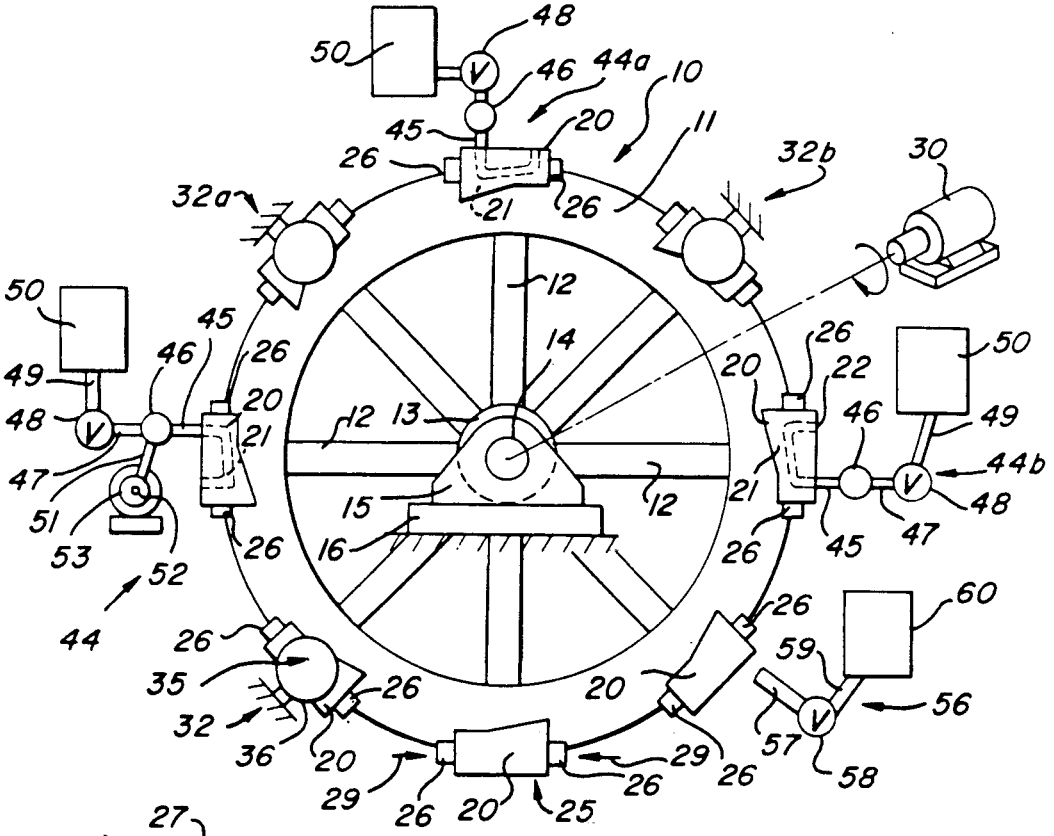
FIG. 1 is a schematic, elevational view of the equipment carrying a number of cast parts for cleaning.

FIG. 1 schematically illustrates an apparatus for cleaning castings. The apparatus includes a wheel-like frame 10 having a rim 11, connected by spokes 12 to a hub 13. The hub is mounted upon an axle 14 which is supported in bearings 15. The bearings are mounted upon a fixed support 16, which is schematically illustrated.

A cast metal part 20, as for example a cast iron block-like part, is provided with internal passageways 21. The shapes, lengths and number of the passageways or other cavities may vary considerably. For illustration purposes, the passageways or cavities are shown being U-shaped with opposite end openings 22 and 23 which communicate with different portions of a surface of the casting. The passageways may extend completely through the cast metal part, in a more straight direction, or may be otherwise curved in shape. In addition, instead of longer passageways, the part may include cavities of various shapes which communicate to exterior portions of the surfaces of the casting through openings. Thus, the use of the passageways includes other cavities.

Figure 2:
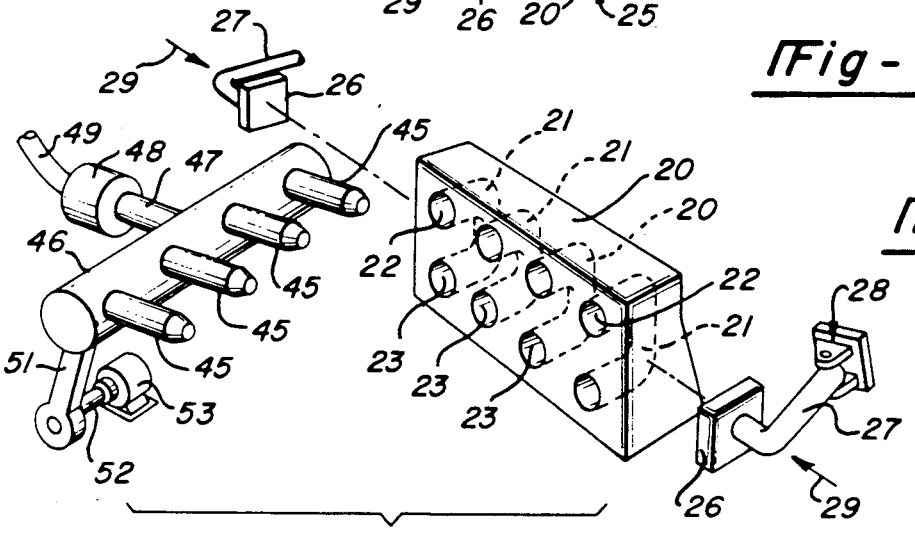
FIG. 2 is a schematic, fragmentary, perspective view showing a cast part and the air blast nozzle arrangement.

The casting is mounted upon the ferris wheel-like frame 10 at a lower loading station 25. Suitable clamps 26 which are schematically illustrated as being mounted upon levers 27 that are pivotally connected, through pivot brackets 28, upon the wheel rim 11, grasp and clamp the cast part. A suitable mechanism is provided (not shown) for pivoting the clamp levers and holding the clamps in clamping engagement with the cast part. That movement is illustrated by arrows 29, shown in FIGS. 1 and 2. The particular construction of the mechanism for operating the clamps and the clamp construction may vary considerably and may be selected, from commercially available clamping systems, by those skilled in the art.

Figure 3:
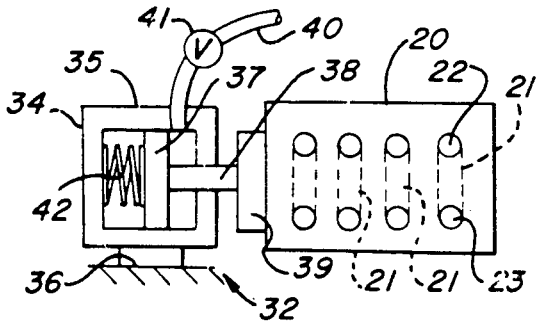
FIG. 3 is a schematic, fragmentary, partially cross-sectional view, showing a vibrator applying vibration to a cast part.

The wheel-like frame is rotated, for example, in a clockwise direction, by means of a suitable motor 30 connected to the axle 14 through an appropriate speed control and the cast part is rotated or indexed through a number of stations. The second station 32 is provided with a vibrating mechanism. Referring to FIG. 3, the vibrating station 32 includes a vibrator 34 which is schematically shown as comprising a cylinder 35 mounted upon a fixed support 36 adjacent the wheel frame. Thus, the vibrating station 32 is stationary relative to the rotating wheel.

The vibrator cylinder 34 includes a piston 37 having a piston rod 38 which extends outwardly of the cylinder and carries a vibrator pad 39 which contacts a face of the cast part.

A compressed air hose 40 provides compressed air from a conventional compressed air source (not shown) to one side of the piston 37 and is operated by a conventional timing valve 41 which turns the air flow on and off. Resisting the movement of the piston is a spring 42 within the cylinder. Thus, when the air valve 41 is turned off, the spring 42 moves the piston to the right, as shown in FIG. 3. Conversely, when the air valve 41 is turned on, the compressed air moves the piston to the left, against the force of the spring. In this manner, the pad 39 is vibrated rapidly.

Other forms of vibrators are commercially available, including electrically and electromagnetically operated vibrators. Since they are commercially available, it is contemplated that any suitable vibrator, giving the desired speed of vibration, may be selected by those skilled in the art to perform the required vibration of the part. The amplitude and speed of vibration will depend upon the part size, shape and structure and can be determined by trial and error.

After the part is vibrated at the vibration station 32, it moves clockwise to an air blast station 44. Here, a gang of nozzles 45 are mounted upon a manifold 46 which is connected by a tube 47 to a valve 48. The valve communicates, through a pipe 49 to an air source 50. The air source, such as a compressed air tank or an air compressor, provides high pressure air, such as in the order of 100 to 110 PSIG. The air source provides short duration air bursts. Therefore, the air source system must be of a type which rapidly recovers its air pressure upon release of the air burst. Commercially available air turbines or compressors of sufficient capacity are available to supply high pressure air in short, rapidly applied bursts with rapid recovery.

The manifold 46 is mounted in such a manner as to move towards the cast art so that the nozzles 45 enter into or communicate with the entrances or openings 22 at one of the passageways 21. The means for moving the manifold towards the casting is schematically illustrated as comprising a lever 51 connected to a rotating shaft 52 on a reversible motor 53. Operation of the motor 53 moves the lever 51 to cause the manifold, with the nozzles to move either towards or away from the casting, as desired. Suitable controls are provided for cycling and operating the movement of the manifold, However, these are not shown since conventional, commercially available, controls may be used for this purpose.

A series of alternating vibrating stations are provided. Thus, the wheel rotates or indexes the metal part, after the air burst station 44 to the next vibration station **32*a*, hen to air burst station 44*a*, vibration station 32*b*, and air burst station 44*b***. The number of these alternating stations may vary, depending upon the desired number of cleaning cycles through which the part is to be passed.

Since the cast part is rotated by the ferris wheel-like frame, the angle of the part, relative to horizontal, is changed as it cycles through the successive vibration and air burst stations. The movement of the frame is intermittent in that it rotates a predetermined number of degrees for indexing the part and then it is momentarily stationary while the part is treated at the respective vibrating and air burst stations.

The air burst is applied virtually instantaneously. For example, it may be applied within a matter of a few milliseconds like a shot or almost instantaneous blast of air.

After the part has passed through the vibration and air burst cycles, it may pass through a final air blast station 56 which is provided with one or more nozzles 57 controlled by a valve 58 for blasting compressed air upon and around the part and its openings. Compressed air is fed to the valve and the nozzles through a pipe 59 connected to a compressed air source 60. This compressed air source 60 may provide a steady air blast for a longer duration for completely air cleaning the part before it is indexed back to the load station 25.

Once the part returns to the loading station 25, it may be removed by releasing the clamps 26 and a fresh casting inserted in its place. Hence, the equipment may require some labor for loading and unloading the parts or may utilize some conventional material handling equipment for the purpose. Otherwise the operation of the equipment is automatic.

Because of the rotative movement which changes the angle of the part, the force of gravity helps dislodge sand and other casting debris from the walls of the openings and out of the openings. Thus, the successive application of vibrations and air bursts to the differently angled part either completely or substantially completely cleans the passageway walls.

This invention may be further developed within the scope of the following claims. Accordingly, it is desired that the foregoing description be read as being merely illustrative of an operative embodiment of this invention, and not in a strictly limited sense.

Having fully described an operative embodiment of this invention, we now claim:

1. Apparatus for cleaning sand and other casting debris from a metal casting having a passageway extending therethrough and opening onto different surface portions of the casting, comprising:

a horizontal axis wheel-like frame having means for rotating the frame around its horizontal axis;

means for securing a casting upon the frame for rotation therewith around the horizontal axis;

vibration means arranged along the path of rotation of the casting for periodically vibrating the casting;

means for momentarily introducing a high pressure burst of air during a period measured in milliseconds into the opening in the casting passageway, between periods of vibration of the casting;

whereby a casting is cyclically subjected to periods of vibration and periods of bursts of air for loosening and blowing sand and other casting debris from the casting and from the passageway within the casting.

2. An apparatus as defined in claim 1, and said means for rotating the frame being intermittently operable for momentarily stopping the rotation of the frame and, thereby, momentarily holding the casting stationary during the periods of vibration and the periods of introducing the bursts of air.

3. An apparatus as defined in claim 2, wherein said means for securing the casting upon the frame holding the casting substantially immovable relative to the frame so that during a portion of the movement of the casting with the frame along the path of rotation, the angle of the casting changes and the passageway opening becomes oriented downwardly for allowing gravity to cause sand and other casting debris to drop from the passageway.

4. Apparatus as defined in claim 1, and including said frame having a number of circumferentially spaced apart similar means for securing castings upon the frame, whereby a number of similar castings may be simultaneously secured upon and rotated with the frame and may be vibrated and subjected to bursts of air during a single rotation of the frame.

5. Apparatus as defined in claim 4, and said means for introducing the burst of air comprising a number of nozzles and means for simultaneously inserting and removing the nozzles from a number of adjacent open ends of a number of passageways formed in the casting;

said nozzles being connected to a single source of high pressure air;

said means for introducing causing a burst of high pressure air to flow through the nozzles when the nozzles are inserted within the passageways and for discontinuing air flow through the nozzles at other times.

* * * * *